US005943924A

United States Patent [19]

Jarvis

[11] Patent Number: 5,943,924

[45] Date of Patent: Aug. 31, 1999

[54] INTEGRAL MULTI-SIZED SOCKET TOOL

[76] Inventor: Jack D. Jarvis, 3204 Periwinkle, Memphis, Tenn. 38127

[21] Appl. No.: 08/878,231

[22] Filed: Jun. 18, 1997

Related U.S. Application Data

[63] Continuation of application No. 08/398,691, Mar. 6, 1995, abandoned.

[51] Int. Cl.[6] ..... B25G 1/04; B25B 23/16

[52] U.S. Cl. ..... 81/177.2; 81/60; 81/185

[58] Field of Search ..... 81/52, 473, 478, 81/58, 58.1, 60, 438, 439, 440, 450, 177.2, 177.8, 177.9, 177.85, 185

[56] References Cited

U.S. PATENT DOCUMENTS

| | | | |
|---|---|---|---|
| 2,803,980 | 8/1957 | Vogel | 81/60 |
| 2,982,160 | 5/1961 | Little | 81/60 |
| 4,279,314 | 7/1981 | Taub | 81/61 |
| 4,324,158 | 4/1982 | Le Roy | 81/60 |
| 4,979,355 | 12/1990 | Ulevich | 81/185 |
| 5,289,745 | 3/1994 | Beardsley | 81/177.2 |
| 5,291,809 | 3/1994 | Fox, III et al. | 81/177.2 |

FOREIGN PATENT DOCUMENTS

| | | | |
|---|---|---|---|
| 0027238 | 4/1981 | European Pat. Off. | 81/177.9 |

*Primary Examiner*—Willis Little
*Attorney, Agent, or Firm*—Paul M. Denk

[57] ABSTRACT

An adjustable hand tool comprising an integral multi-sized socket tool, including a drive handle, and a multi-tiered drive mountable to said drive handle, said multi-tiered drives providing either a series of tiers of drives all extending concentrically from one end of the drive, or said drives being provided to either end of the tool, and capable of being shifted within the drive to provide for a drive of one dimension upon one of its ends, and a drive of a different dimension upon the opposite end, and said tiered drives being shiftable within the multi-tiered drive to provide for exposure at either end. The various drives may be of rounded shape, so as to function in a manner similar to a universal joint, while the handle is manipulated for turning of its drive, as when used for tightening or loosening a bolt. The ratchet portion of the drive may include locking means, so as to lock the ratchet head and socket relative to its handle, once adjusted into an operative position.

4 Claims, 8 Drawing Sheets

INTEGRAL MULTI-SIZED SOCKET TOOL

CROSS REFERENCE TO RELATED APPLICATION

This application is designated as a continuation of the application of the same inventor, having Ser. No. 08/398,691, filed on Mar. 6, 1995, now abandoned, said applications being owned by a common inventor.

BACKGROUND OF THE INVENTION

This invention relates generally to hand tools, more specifically to multifunctional, adjustable socket wrenches. Socket wrenches are well known to the art. Heretofore, however, socket wrenches were provided having only one drive size. The present invention provides a socket wrench system with interchangeable, variable sized drives.

A socket wrench set generally has a ratcheting drive handle and a plurality of interchangeable sockets. The sockets are open-ended. One open end is designed to fit over a nut or bolt head and the other end is designed to attach to the drive on the drive handle. The end that attaches to the drive handle has a rectangular opening sized to fit the drive. For example a socket designed to mate with a ¼ inch drive would have a ¼ square opening to accommodate attachment to the drive. A larger drive allows for more torque to be applied on the wrench. The drive handle is necessarily heavier to accommodate the larger drive. A mechanic who does a variety of jobs must have more than one set of socket wrenches. Generally the mechanic will have a set of ¼ inch drive sockets for lighter applications and a set of ½ inch or even a set of ¾ inch drive sockets for heavier applications. Of course, having a large inventory of wrenches increases costs and requires extra storage space. Furthermore, if the mechanic is in the middle of a job and determines that he needs a different size socket set, he has to interrupt his work to get another set of wrenches.

Another notable drawback with prior art socket wrenches is that they often are difficult to apply to hard to reach places. This is because the socket drive handle is straight. If the application site is not in a straight line from the user, it is not accessible with the wrench.

SUMMARY OF THE INVENTION

It is, therefore, a principal object of the present invention to provide a set of multifunctional socket wrenches that has interchangeable drives and interchangeable sockets so that one set of wrenches can be used in a variety of applications.

Another object of the invention is to provide a multifunctional socket wrench set having a drive handle that articulates at least 180 degrees to allow application of the wrench to hard to reach places.

It is another object of the present invention to provide a set of multifunctional socket wrenches that are simple to manufacture, easy to use, and well suited for their intended purpose.

In accordance with the invention, generally stated, a multifunctional, interchangeable socket wrench set is provided having a drive handle and a plurality of interchangeable sockets. The drive handle has an integral ratcheting drive of a given dimension. An interchangeable multi-tiered drive is provided that is attachable to the integral drive. The multi-tiered drive provides a plurality of tiers of different dimensions thereby changing the dimension of the drive. Open ended sockets are provided. One end of the socket is configured to fit over the application object, such a bolt head or nut, etc. The other end is configured to attached to the drive. The attachment end of the socket is configured to attach to any one of the plurality of the drive tiers, thereby allowing the user to change size of drives and/or size of sockets on the same wrench. Extensions are provided for furnishing interconnection of various sockets and drives together from multiple larger sizes such as 1" or ¾", and for connecting with drives down to, for example, ¼", or vice versa. In one preferred embodiment the drive handle is provided with an articulating joint that allows the drive end of the handle to be rotated approximately 180 degrees relative to the handle and be locked in position.

DESCRIPTION OF THE PREFERRED EMBODIMENT

Figure 1:
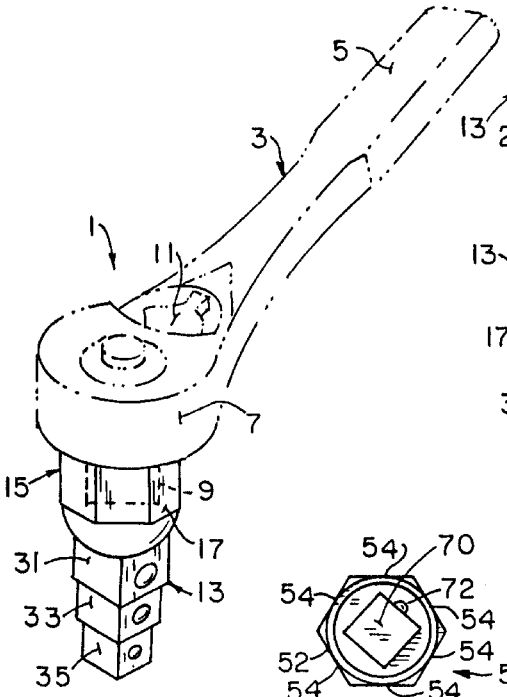
FIG. 1 is an isometric view of one preferred embodiment of the adjustable hand tool of the present invention.
Figure 2:
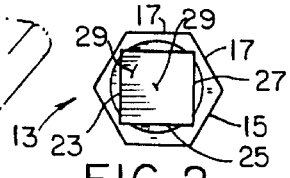
FIG. 2 is top plan of the multi-tiered drive element of the hand tool of the present invention.
Figure 5:
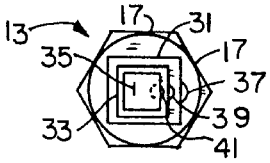
FIG. 5 is a bottom plan thereof.
Figure 3:
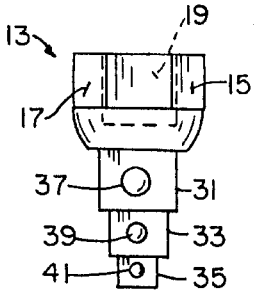
FIG. 3 is a side elevational view thereof.
Figure 4:
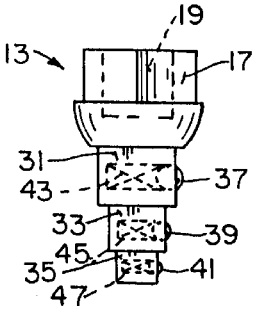
FIG. 4 is another side elevational view thereof.
Figure 7:
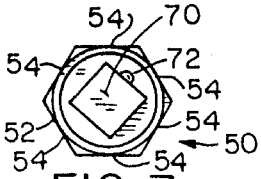
FIG. 7 is a bottom plan thereof.

One preferred embodiment of the adjustable hand tool of the present invention is indicated generally by reference numeral 1 in FIG. 1. Tool 1 has a handle 3. Handle 3 has an elongated handle portion 5 and a rounded head portion 7. Head portion 7 has a ratcheting drive 9. Drive 9 is a conventional socket drive connected to a conventional ratcheting gearworks inside head portion 7. A conventional thumb lever 11 controls the direction drive 9 can rotate relative to head portion 7. It will be appreciated that drive 9 can be any desired size from ¼ inch to ¾ square. Drive 9 is designed to seat a convention socket from a conventional socket wrench set. Therefore, if drive 9 is ¾, a ¾ inch socket must be used with tool 1. It will also be appreciated that the larger the size of the drive, i.e. ¾ inch, greater is the amount of torque can be applied to the tool. Thus tools having larger drive sizes are used for heavier applications. The principles of the present invention, as will now be described, apply regardless of the size of drive 9.

A multi-tiered drive adapter 13 is attached to drive 9. Adapter 13 is shown in greater detail in FIGS. 2–7. Adapter 13 has a body 15. Body 15 has a plurality of facets, as at 17. The facets 17 allow the application of a conventional open-end wrench to apply additional torque to the drive, if necessary. Body 15 has a bore 19 formed in a top or first end. Bore 19 is quadrilateral and defined by internal walls 21, 23, 25, 27 as well as bottom wall 29. Bore 19 is dimensioned to seat drive 9 therein. Drive 9 has a spring biased detent ball (not shown) to secure adapter 13 on drive 9. Body 15 has a plurality of tiers 31, 33 and 35 integrally formed on the bottom or second end. As illustrated, adapter 13 has three tiers that decrease in size from body 15 outward. Tier is larger than tier 33 and tier 33 is larger than tier 35. The sizes of the respective tiers depend upon the desired application of the tool. For example, if drive 9 is ¾ inch, tier 31 might be ½ inch, tier 33 might be 7/16 inch and tier 35 might be ¼ inch. It will be appreciated that the dimensions are variable between applications and the scope of the invention is intended to include any practical or useful combination of sizes of tiers. Each tier has a spring biased detent ball 37, 39, 41 recessed in cavities 43, 45, and 47 respectively. Adapter 13 functions to step down the size of drive 9. For example a user employing tool 1 having a ¾ inch drive 9 may desire to use a ¼ inch socket, that is, a small socket having a drive-seating bore ¼ by ¼ inch. Adapter 13 having a ¾ inch bore 19 is attached to drive 9. A ¼ inch socket is attached to tier 35 and secured by detent ball 41. This the user of a large, ¾ inch drive socket wrench can employ a small ¼ inch socket. It will be apparent that a 7/16 socket could be attached to tier 33 or a ½ inch socket attached to tier 31. Thus, adapter 13 allows a conventional socket wrench drive handle to accommodate a wide range of sizes of sockets.

FIGS. 6–9 illustrate a variable size extension for the adjustable-hand tool of the present invention, indicated generally by reference numeral 50. Extension 50 has a generally elongated handle section 52. Handle section 52 has external knurling 53 to facilitate gripping by the user. Around the top or first end of handle section 52 is a plurality of facets 54 to facilitate the application of a conventional wrench, if necessary. A bore 55 is formed in the top end of the handle section. Bore 55 is defined by internal walls 57, 59, 61, and 63 as well as bottom wall 65. Bore 55 is configured and dimension to accommodate drive 9 or any other appropriate drive. For example, bore 55 could be dimensioned to accommodate one of the tiers on adapter 13, thus enhancing its versatility. For example, a further counterbore 57*a*, of approximately ½ inch dimension may be provided interiorly of extension 50, to accommodate and adapter of that size also. Or, a counterbore socket of ¼", or the like, may be provided in the extension 50, as shown at 57*b*, in FIG. 8. There is a shoulder 67 at the bottom or second end of handle section 52. An elongated extension section 69 is integrally formed on shoulder 67. Extension section 69 can be as long as desired. A drive 70 is integrally formed on the bottom end of extension section 69. There is a spring biased detent ball 72 in cavity 73 formed in one side of drive 70. Variable size extension 50 is designed to a smaller socket at drive 70 on a larger drive, for example drive 9 previously described. Furthermore the extension allows application of the socket to hard to reach places.

Figure 10:
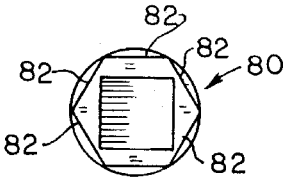
FIG. 10 is a top plan of an adapter element of the adjustable hand tool of the present invention.
Figure 6:
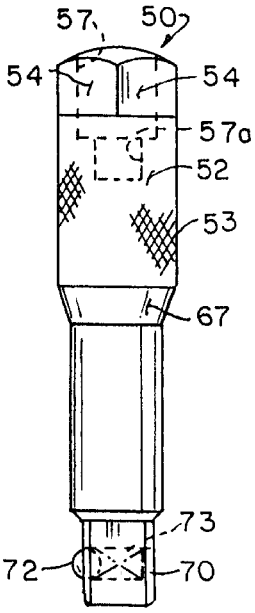
FIG. 6 is a side elevational view of the extension element of the adjustable hand tool of the present invention.
Figure 8:
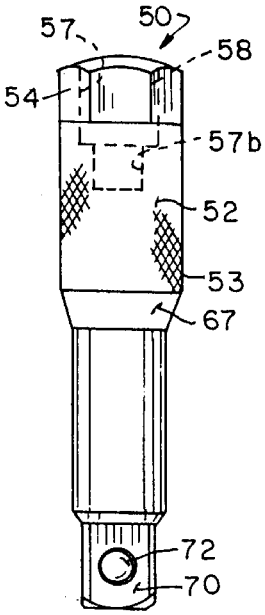
FIG. 8 is another side elevational view thereof.
Figure 11:
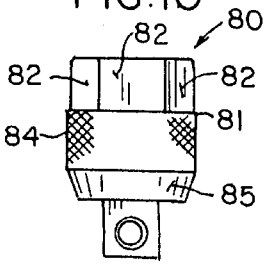
FIG. 11 is a side elevational view thereof.
Figure 12:
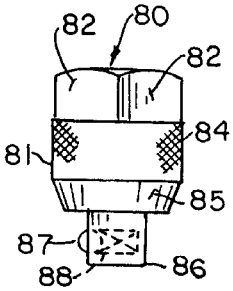
FIG. 12 is another side elevational view thereof.
Figure 13:
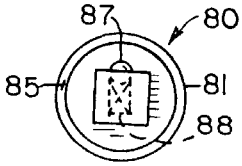
FIG. 13 is a bottom plan thereof.
Figure 9:
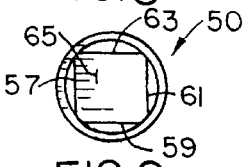
FIG. 9 is a top plan thereof.
Figure 14:
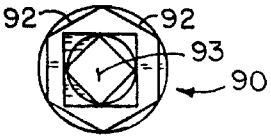
FIG. 14 is a top plan of another adapter element of the adjustable hand tool of the present invention.
Figure 15:
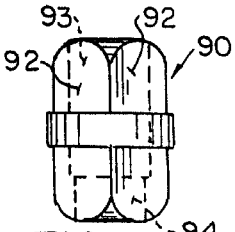
FIG. 15 is a side elevational view thereof.
Figure 16:
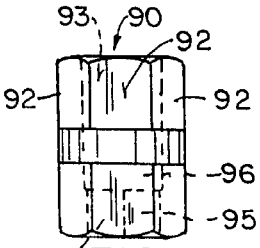
FIG. 16 is another side elevational view thereof.
Figure 17:
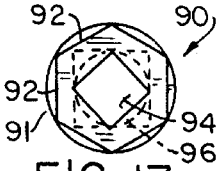
FIG. 17 is a bottom plan thereof.
Figure 18:
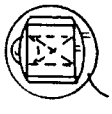
FIG. 18 is a top plan of another extension element of the adjustable hand tool of the present invention.
Figure 19:
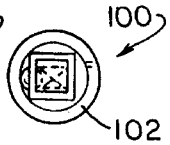
FIG. 19 is a bottom plan thereof.

A drive reducing adapter is indicated generally by reference numeral 80 in FIGS. 10–12. Adapter 80 has a body 81. Body 81 has a plurality of facets 82 around the top of first end. A drive receiving bore 83 is formed in the first end. There is knurling 84 on the exterior of body 81 below the facets. There is a shoulder 85 integrally formed on the bottom or second end of the adapter. A small drive 86 is integrally formed on shoulder 85. There is a spring biased detent ball 87 in cavity 88 formed in one side of drive 86.

Adapter 80 can be connected between a large drive and small socket or between a drive and a small extension or any combination thereof.

FIGS. 14–17 illustrate another embodiment of an adapter indicated generally be reference numeral 90. Adapter 90 has a body 91. A plurality of facets 92 are formed around the first or top end. A bore 93 is formed in the first end. Bore 93 is configured and dimensioned to accept a drive on a drive handle or a drive one the end of an adapter, such as adapter 80 or the drive in the end of an extension. A second bore 94 is formed in the second end of body 91. Bore 94 has a first chamber 95 and a larger chamber 96. Thus bore 94 can accommodate one of two different size drives.

FIGS. 18–21 illustrate another embodiment of an extension, indicated generally by reference numeral 100. Extension 100 has an elongated body 101 which can be of any desirable or practical length. There is a flared shoulder 102 at the first or top end of body 101. A first drive 103 is integrally formed on shoulder 102. It will be appreciated at drive 103 has a generally rounded or barrel-shaped configuration, and this affords a generally universal joint type of movement when the extension is used for wrench purposes. There is a spring biased detent ball 104 in cavity 105. Drive 103 is dimensioned to fit into any appropriately sized bore of a conventional socket and retained by detent ball 104. It will be appreciated, however, that the barrel-shaped configuration allows drive 103 limited movement inside the bore thus allowing for limited articulation at that juncture. Shoulder 102 prevents excessive bending and disengagement. A second drive 106 is formed at the second or bottom end of body 101. Second drive 106 is smaller than first drive 103. There is a shoulder 107 between body 101 and drive 106. There is a spring-biased detent ball 108 in cavity 109. Drive 106 is dimensioned and configured to engage the bore of a conventional socket of a desired size. Also, the rounded shape allows for some flexure at the point of attachment, as approximately to 15° to 20° off the axial dimension of the extension 100, for achieving this purpose. Extension 100 is used to increase the distance from the drive handle to the socket, Since drive 103 is larger than drive 106, it acts as a stop down from a large drive to a small socket.

Figure 22:
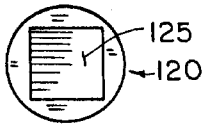
FIG. 22 is a top plan of an adapter element of the adjustable hand tool of the present invention.
Figure 23:
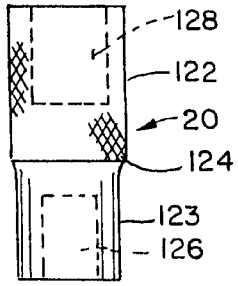
FIG. 23 is a side elevational view thereof.
Figure 24:
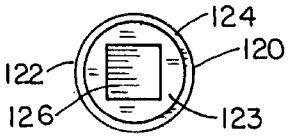
FIG. 24 is a bottom plan thereof.
Figure 20:
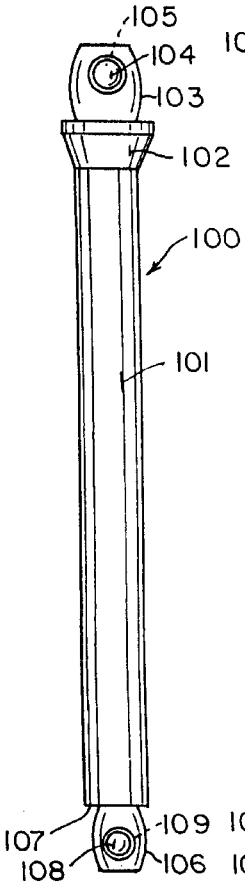
FIG. 20 is a side elevational view thereof.
Figure 21:
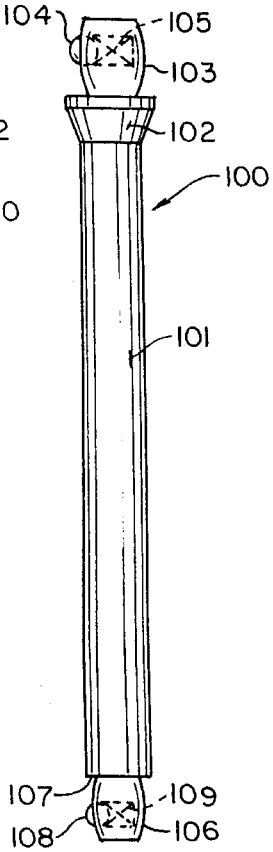
FIG. 21 is another side elevational view thereof.
Figure 25:
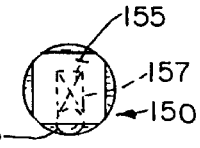
FIG. 25 is a top plan of an adapter element of the adjustable hand tool of the present invention.
Figure 26:
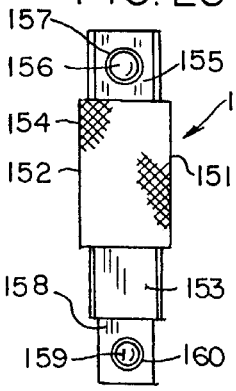
FIG. 26 is a side elevational view thereof.
Figure 27:
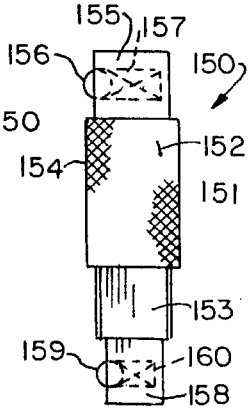
FIG. 27 is another side elevational view thereof.
Figure 28:
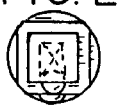
FIG. 28 is a bottom plan thereof.
Figure 29:
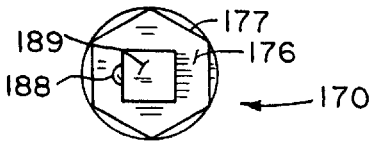
FIG. 29 is a top plan of an adapter element of the adjustable hand tool of the present invention.

FIGS. 22–24 illustrate another adapter, indicated generally by reference numeral 120. Adapter 120 has a body 121 with an upper segment 122 and a lower, concentric segment 123. There is a shoulder 124 between the two segments. The outer surface of upper segment 122 is knurled. A first bore 125 is formed in the upper segment and generally configured to accommodate the insertion of a drive. It will be appreciated, however, that bore 125 is deeper than convention bores so as to accommodate the insertion of a multi-tiered adapter, such as adapter 13 previously described, and allow the largest tier 31 to seat therein. A second bore 126 is formed in lower segment 123. Bore 126 is dimensioned and configured to seat a drive. Bore 126 is smaller than bore 125. However, bore 126 is deeper than conventional bore to allow the insertion of a multi-tiered adapter. However, a smaller tier, such as tier 33 of adapter 13 will seat in bore 126 thus creating a step-down.

FIGS. 25–28 illustrate another adapter indicated generally by reference numeral 150. Adapter 150 had a body 151 having a upper segment 152 and a lower, concentric segment 153. The outer surface of upper segment 152 has knurling 154. A first drive 155 is integrally formed on the upper segment. Drive 155 has a spring biased detent ball 156 in cavity 157. It will be noted that drive 155 is relatively large, generally conforming to the dimensions of a ¾ inch or ½ inch conventional drive. A second drive 158 is integrally formed on lower segment 153. Drive 158 is smaller than drive 155, generally conforming to the dimensions of a 7/16 inch or ¼ inch conventional drive. Drive 158 has a spring biased detent ball 159 in cavity 160.

Figure 30:
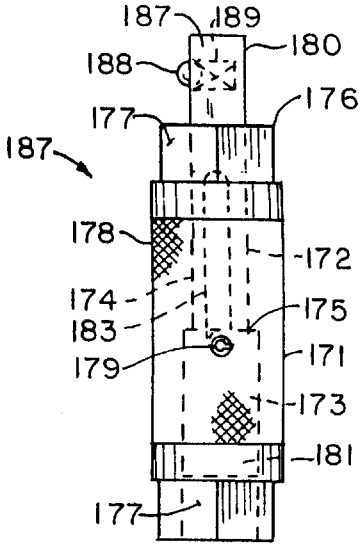
FIG. 30 is a side elevational view thereof with the slidable insert in a first position.
Figure 31:
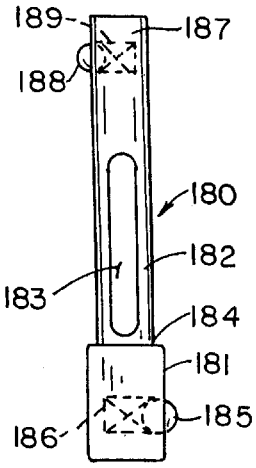
FIG. 31 is a side elevational view of the slidable insert from the adapter element shown in FIG. 30.
Figure 32:
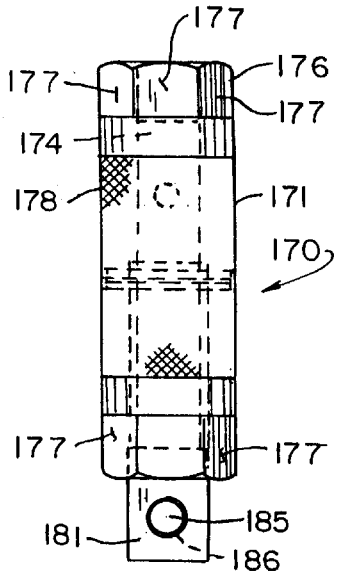
FIG. 32 is a side elevational view of the adapter of FIG. 30 with the slidable insert in a second position.
Figure 33:
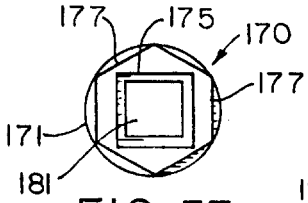
FIG. 33 is a bottom plan of the adapter of FIG. 30.
Figure 34:
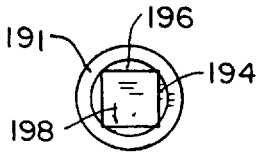
FIG. 34 is a top plan of an adapter of the adjustable hand tool of the present invention.

FIGS. 29–33 illustrate a slidably changeable adapter indicated generally by reference numeral 170. Adapter 170 has an outer sleeve 171. Sleeve 171 is an elongated tubular structure having a bore 172 formed therethrough. Bore 172 has a lower chamber 173 and a concentric upper chamber 174 defined by internal shoulder 175. Lower chamber 173 is dimensioned and configured to accept an appropriately sized drive and upper chamber also can accommodate a smaller drive as will be explained below. Sleeve 171 has an upper collar 176 comprised of a plurality of facets 177 and a lower collar comprised of a plurality of facets 177. Sleeve 171 has external knurling 178. A pin extends through body 171. A slidable insert 180 is slidably engaged in bore 172. Insert 180 has a base section 181 and an elongated concentric upper section 182. Upper section has a slot 183 formed centrally therein. The previously mentioned pin 179 extends through slot 183 to secure insert 180 in bore 172. There is a shoulder 184 the respective sections. Base section 181 is dimensioned and configured to function as a first drive. There is a spring biased detent ball 185 in cavity 186. A second drive 187 is integrally formed from the upper end of upper section 182. Drive 187 is smaller than drive than the first drive. There is a spring biased detent ball 188 in cavity 189. As shown in FIG. 30, upper section 182 fits in upper chamber 174 and lower section 181 fits in lower chamber 174. Slideable insert 180 can be moved within bore 172 until shoulder 184 abuts shoulder 175. Drive 187 extends out of the sleeve in a usable position. Moreover, base section 181 moves up in lower chamber 173 allowing chamber 173 to function as a seat or socket for an appropriately sized drive. As shown in FIG. 32, slidable insert 180 can be withdrawn into bore 173 so that upper chamber 174 can function as a seat or socket for an appropriately dimensioned drive. Base section 181 extends out of lower chamber 173 to function as a drive. Base 181 can engage an appropriately dimensioned socket or another adapter or extension. Obviously, the dimensions of these sockets and drives may vary in the designed adapter 170 to accommodate the requirements of the user.

Figure 35:
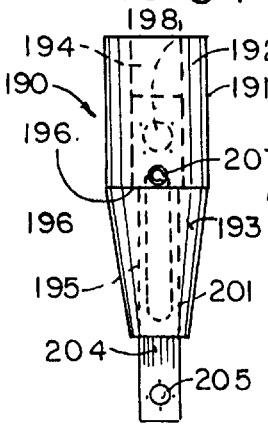
FIG. 35 is a side elevational view thereof with the slidable insert in a first position.
Figure 36:
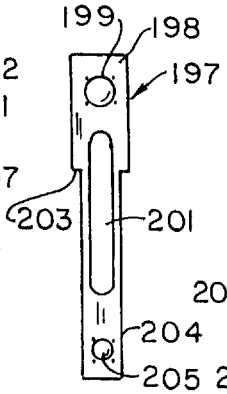
FIG. 36 is a side elevational view of the slidable insert of the adapter of FIG. 35.
Figure 37:
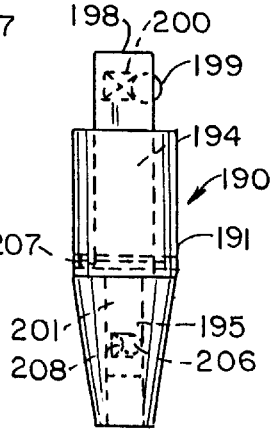
FIG. 37 is another side elevational view of the adapter of FIG. 35 with the slidable insert in a second position.
Figure 38:
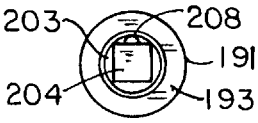
FIG. 38 is a bottom plan of the adapter of FIG. 35.

FIGS. 34–38 illustrate another embodiment of a slidably changeable adapter indicated generally be reference numeral 190. This is similar to the functioning of the adapter 170. Adapter 190 has a generally elongated sleeve 191. Sleeve 191 has a tubular upper section 192 and an integral frusto-conical lower section 193. The frusto-conical configuration allows for the use of a slidably insert have a greater disparity in sizes between its ends as will be explained below. Upper 192 section has a bore 194 formed therethrough. Lower section 193 has a bore 195 formed therethrough concentric to bore 194. There is a shoulder 196 between the respective bores. There is a slidable insert 197 in sleeve 191. Insert 197 has an upper section 198 configured and dimensioned to function as a first drive. There is a spring biased detent ball 199 in cavity 200. Insert 197 has an elongated lower section 201 concentric to upper section 198. It will be noted that upper section 198 is considerably greater in width and depth than lower section 201. For example, the upper section can be ½ or ¾ inch square whereas the slower section can be ¼ inch to 7/16 inch square. Lower section 201 has a slot 202 formed therein. There is a shoulder 203 between the respective upper and lower sections. Lower section 201 has a second drive 204 integrally formed therefrom. Second drive 204 is generally smaller than the first drive. There is a spring biased detent ball 205 in cavity 206. A pin 207 extends through sleeve 191 and slot 202 to secure the insert in place. As shown in FIG. 35, insert 197 can be moved within sleeve 191 so that upper section 198 moves within bore 194 until shoulder 203 abuts shoulder 196. Drive 204 extends out of bore 195. Since upper section 198 recedes in bore 194, bore 194 can function as seat for an appropriately dimensioned drive. As illustrated in FIG. 37, insert 197 can be moved up in the sleeve until the bottom of slot 202 engages pin 207. Drive 204 recedes in bore 195 and that bore can function as a seat for an appropriately dimensioned drive. Drive 198 extends out of bore 194 to engage an appropriately dimensioned socket, adapter or extension.

Figures 39, 40, 41, 42:
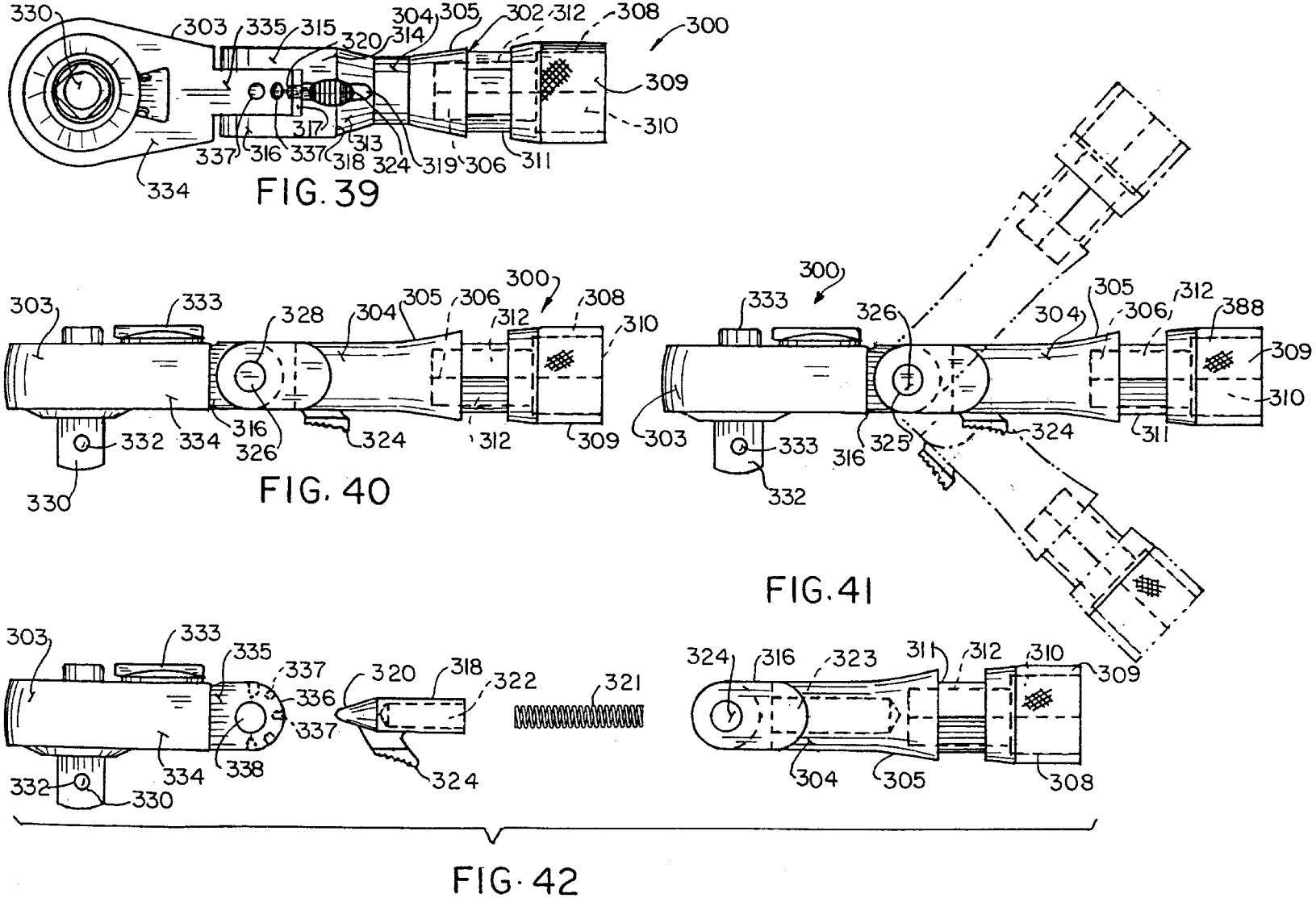
FIG. 39 is a top plan of another preferred embodiment of the adjustable hand tool of the present invention.
FIG. 40 is a side elevational view thereof.
FIG. 41 is another side elevational view thereof.
FIG. 42 is an exploded view thereof.
Figure 43:
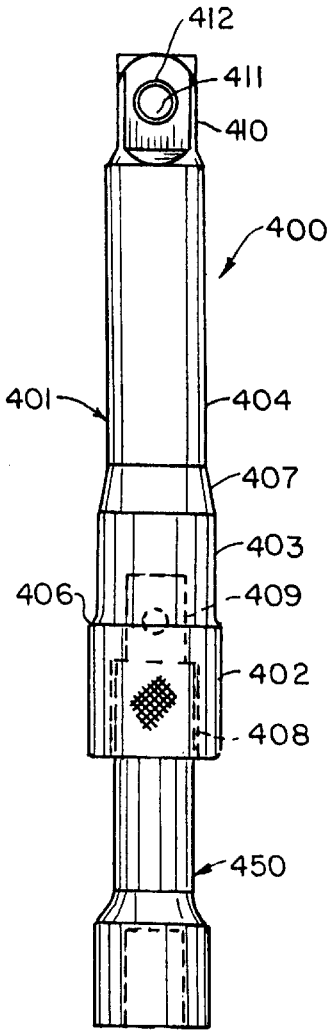
FIG. 43 is a side elevational view of an extension assembly of the adjustable hand tool of the present invention.
Figure 46:
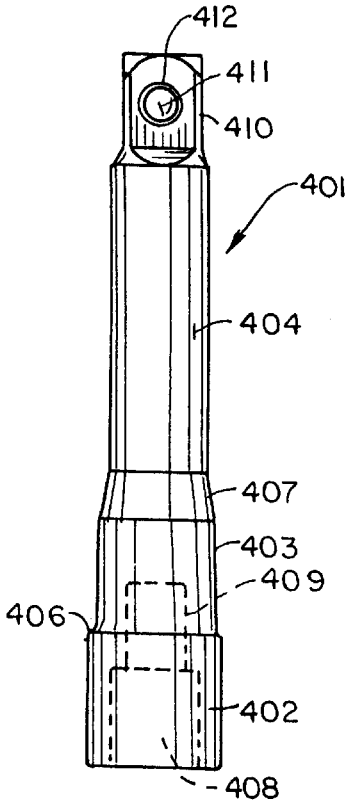
FIG. 46 is a side elevational view of another extension element of the adjustable hand tool of the present invention.
Figure 48:
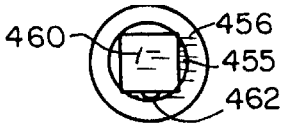
FIG. 48 is a top plan of another extension element of the adjustable hand tool of the present invention.
Figure 49:
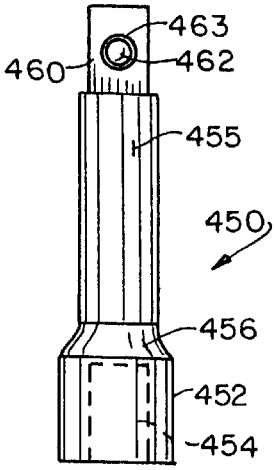
FIG. 49 is a side elevational view thereof.
Figure 50:
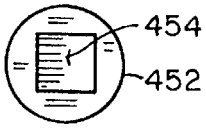
FIG. 50 is a bottom plan thereof.
Figure 44:
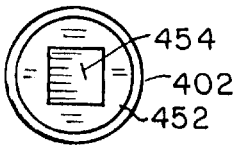
FIG. 44 is a top plan thereof.
Figure 47:
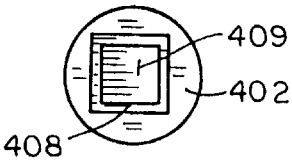
FIG. 47 is a bottom plan thereof
Figure 45:
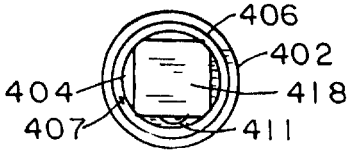
FIG. 45 is a bottom plan thereof

FIGS. 39–42 illustrated another preferred embodiment of the adjustable hand tool of the present invention, indicated generally by reference numeral 300 in the drawings. Tool 300 has an adjustable drive handle 302 and an articulating drive head 303. Handle 302 has a body section 304 with a first flared end section 305. End section 305 has a bore 306 formed therein. Bore 306 is configured and dimensioned to accept any one of a plurality of extensions or handle pieces as will be described in greater detail below. There is an adapter 308 inserted in bore 306. Adapter 308 has a tubular body 309 with a bore 310 formed therein and a concentric fitting 311 with fits into bore 306. Fitting 311 has a bore 312 formed therein. Bore 312 is smaller is size than bore 310. Bores 310 and 312 communicate and form a tiered bore that will seat a tiered adapter as previously described. Body section 304 has a second flared end section 313. which is integrally attached to U-shaped frame 314. Frame 314 has two opposed arms 315 and 316 which define a space 317. As best seen in FIG. 42 a spring biased pin actuator 318 is engaged in slot 319 which communicates between flared end 313 and frame 314. Actuator 318 has a pin 320 biased outwardly toward space 317 by bias spring 321 which seats in bore 322 formed in pin actuator 318. Spring 321 also seats in bore 323 formed in body section 304. Pin actuator 318 has a thumb pad 324 As can be seen in FIGS. 40–42, the respective arms 315 and 316 have holes 324 formed adjacent their respective ends to seat a pivot pin 325. Drive head 303 has a conventional ratcheting socket drive 330 with a detent ball 332. The ratcheting gearworks (not shown) is in the drive head and controlled by thumb lever 333. Drive head 303 tapers to a base 334. A pivot arm 335 extends from base 334. Arm 335 has a rounded end 336. There are a plurality of stop holes 337 formed in the radius of end 336. Holes 337 are dimensioned to allow the insertion of pin 320. A pivot hole 338 is formed through arm 335. Arm 335 fits between arms 315 and 316 and is secured in place by pivot pin 326 inserted through pivot hole 338. FIG. 41 best illustrates the articulating features of tool 300. The user can move pin actuator 318 and withdrawn pin 320 from a stop hole. The drive head 303 pivots about pin 326 until in a desired angular position relative to the handle. The user releases pin actuator 318 and bias spring 321 urges pin 320 into a hole 337 aligned with the pin. When pin 320 is urged into a hole 337, the head of the tool is locked in position relative to the handle. As shown in FIG. 42, the holes 337 are arranged around radius 336 in such a manner that head 303 can be articulated approximately 180°. Rotation of the head relative to the handle allows the application of drive 330 in hard to reach places.

FIGS. 43–53 illustrate additional elements and configurations of tool 300. FIGS. 43–46 illustrate a two piece extension indicated generally by reference numeral 400. Extension 400 has a first or outer extension 401, best illustrated in FIG. 46. Extension 401 has a base section 402, and intermediate body section 403, and an elongated end section 404. There is a shoulder 406 between sections 402 and 403 and a tapered shoulder 407 between sections 403 and 404. Intermediate section 403 is concentric to base section 402 and end section 404 is concentric to intermediate section 403. It will be appreciated that the sections are integral and that extension 401 is machined as one piece from appropriate metal such as steel. Base section 402 has a bore 408 therein. Section 403 has a bore 409 therein. Bore 409 is smaller than bore 408. The respective bores communicate and form a tiered bore arrangement within extension 400. Bores 408 and 409 serves as seats for appropriately dimensioned drives as will be explained below. A drive 410 is integrally formed on the upper end or section 404. There is a spring biased detent ball 411 in cavity 412. It will be appreciated that the dimensions of extension 400 as well as the size of drive 410 are determined by the application of the tool. A second extension 450 is attached to extension 400 at bore 409. Extension 450 has a base section 452 with a bore 454 formed therein. Extension 450 has an elongated upper section 455. There is a tapered shoulder 456 between the two sections. There is a drive 460 integrally formed on the upper end of section 455. There is a spring biased detent ball 462 in cavity 463. Drive 460 is dimensioned to seat in bore 409. It should be noted that bore 454 can be dimensioned to seat drive 410 of extension 401 and that drive 460 is small than drive 410. Thus, extension 450 can be removed from bore 409 and attached to drive 410 as a step down. That is, if drive 410 is a ½ inch drive and drive 460 is a ¼ inch drive, the respective extension can be reversed adding to the versatility of the tool.

Figure 51:
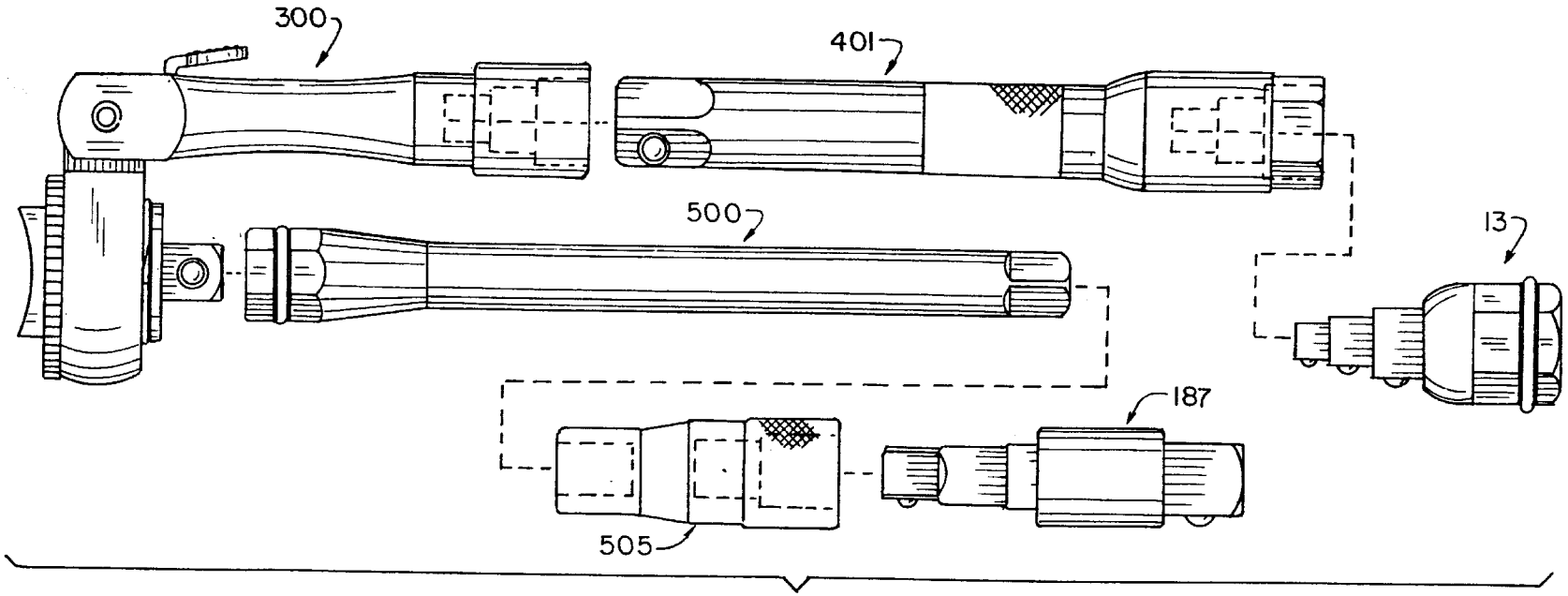
FIG. 51 is an exploded view of another preferred embodiment of the adjustable hand tool of the present invention.
Figure 52:
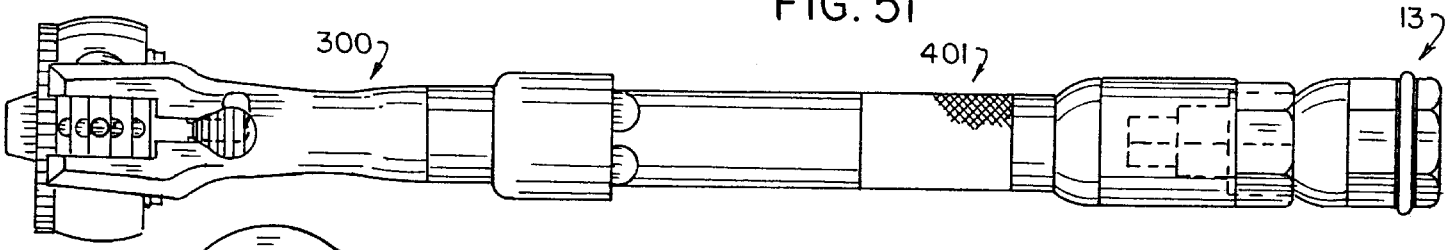
FIG. 52 is a side elevational view thereof.
Figure 53:
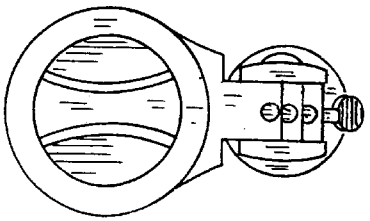
FIG. 53 is a top plan thereof.
Figure 57:
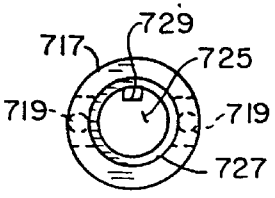
FIG. 57 is a bottom plan thereof.
Figure 54:
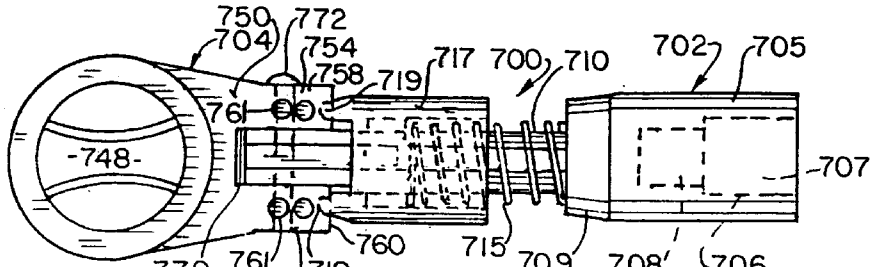
FIG. 54 is top plan of another preferred embodiment of the adjustable hand tool of the present invention.
Figure 55:
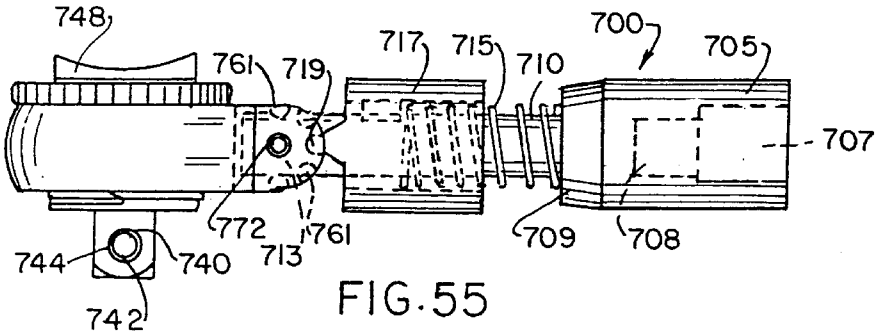
FIG. 55 is a side elevational view thereof.
Figure 58:
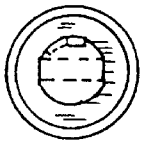
FIG. 58 is a section view taken along lines 58—58 of FIG. 56.
Figure 56:
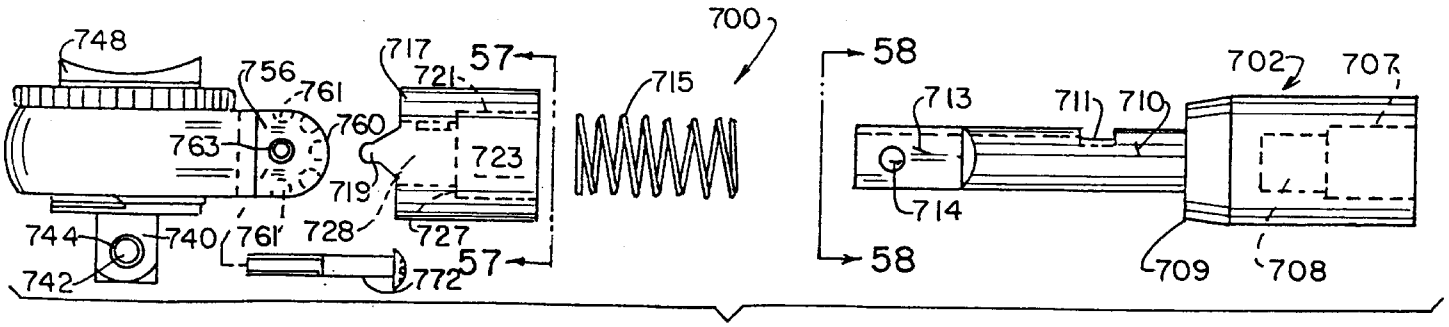
FIG. 56 is an explode view thereof.

FIGS. 51–53 illustrate the versatility and interchangeability of the novel tools previously described. Tool 300 is extended and enhanced by the use of extension 401, multi-tiered drive adapter 13, slidable adapter 187 as well as a conventional socket wrench extension 500 and adapter 505. It will be appreciated by those skilled in the art the number of combinations and arrangements of the various elements are limitless and provide and level of versatility and convenience heretofore unknown in the art.

Figure 59:
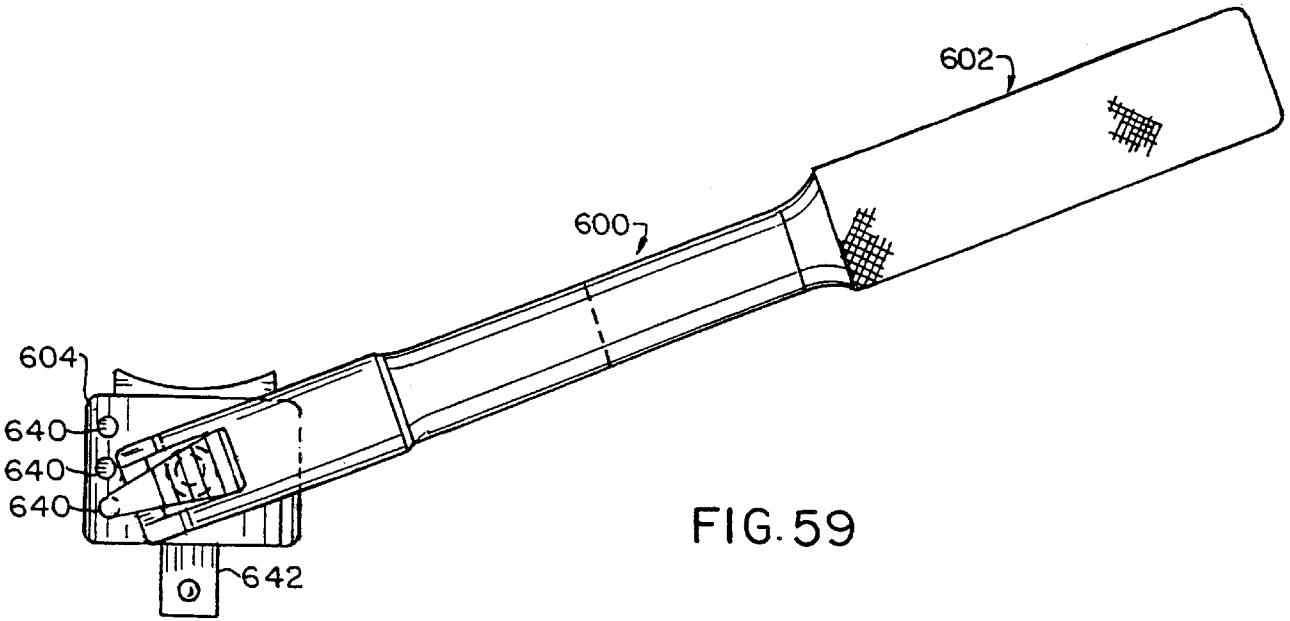
FIG. 59 is a side elevational view of another preferred embodiment of an adjustable hand tool of the present invention.
Figure 60:
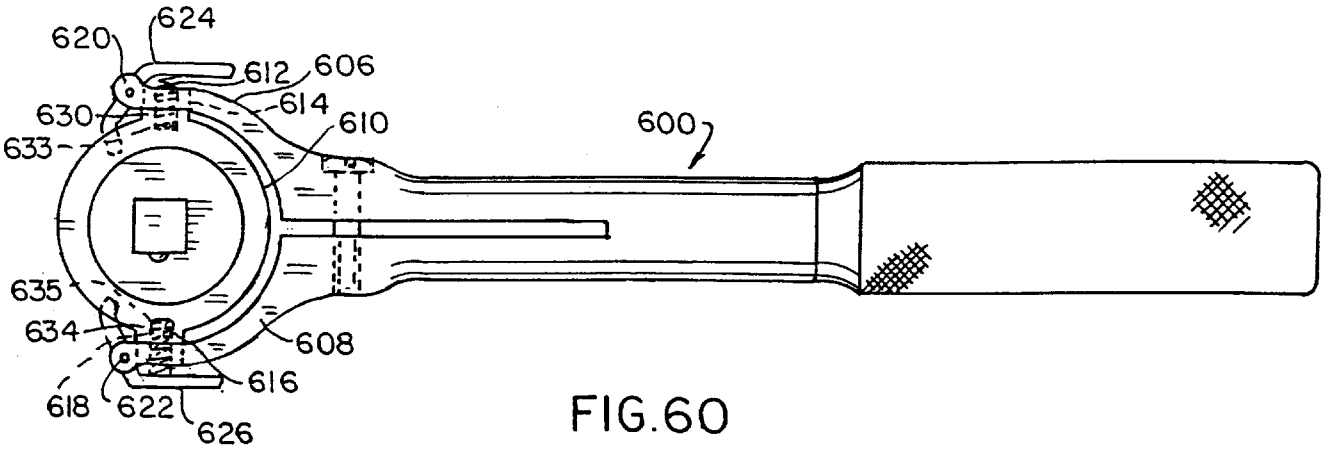
FIG. 60 is a top plan thereof.

FIGS. 59 and 60 illustrate another preferred embodiment of the adjustable hand tool of the present invention indicated generally be reference number 600. Tool 600 has a drive handle 602 and an articulating drive head 604. There is a pair of opposed arms 606 and 608 on the first or upper end of handle 602. The arms define a space 610. There is a bias spring 612 in bore 614 in arm 606. There is a bias spring 616 in bore 618 in arm 608. There are pivots 620 and 622 on the tips of the respective arms. A thumb actuated pivotal locking pin 624 is pivotably attached to pivot 620 and a thumb actuated pivotal locking pin 626 pivotably attached to pivot 622. Articulating drive head 604 is seated in space 610 with clearance to move. Head 604 has a boss 630 with a spring seating bore 633 formed therein on a first side and a boss 634 with a spring seating bore 635 formed therein integrally form on the opposite side. Pivot pins (not shown) are seated inside of springs 612 and 614 and extend through bores 614 and 618 to seat in bores 633 and 635 respectively to hold head 604 in space 610. Head 604 has a line of holes 640 on each side. In a normally biased position, pins 624 and 626 are urged into one of the holes. The pins can be actuated causing the pin to pivot out of the hole. Thus the head 604 can be moved in angular adjustment relative to handle 602. Head 604 has a conventional ratcheting drive 642.

FIGS. 54–58 illustrate another preferred embodiment of the adjustable hand tool of the present invention, indicated generally by reference numeral 700. Tool 700 has a handle

702 and an articulating drive head 704. Handle 702 has a base section 705 with a bore 706 formed therein. Bore 706 has a first or larger chamber 707 and a smaller second chamber 708. The last mentioned chambers are in communication and form a seat for a multi-tiered adapter, as previously described. Moreover, each chamber can accommodate a drive of an appropriate size. An extension can be inserted on either one of the chambers. There is a tapered shoulder 709 on base section 705. An elongated rod 710 extends outwardly from shoulder 709. Rod 710 has a locking groove 711 formed in the surface adjacent shoulder 709. Rod has a forward segment 713 with a pivot hole 714 formed therein. A bias spring 715 seats on rod 710. A locking pin collar 717 is seated on the forward end of rod 710. Collar 717 is generally tubular in shape and has a pair of integral locking pins 719 extending outwardly from opposite sides of collar 717. There is a bore 721 formed through collar 717. Bore 721 has a first chamber 723 and a second chamber 725. There is an internal shoulder 727 between the respective chambers. A detent 729 protrudes into chamber 725. Chamber 723 is dimensioned to allow spring 715 to seat therein and abut shoulder 727. Chamber 725 allows the insertion of flat segment 713 of rod 710 therethrough. Drive head 704 has a conventional ratcheting drive 740 with a spring biased detent ball 742 in cavity 744. A conventional thumb control operates the ratcheting gearworks (not shown) inside head 704. Head 704 has an integral neck 750. Neck 750 has a pair of opposed ears 754 and 756. The outer ends of the respective ears have radii 758 and 760 respectively. A plurality of locking holes 761 are formed in each radius. Each ear has a pivot hole 763 formed therein. There is a space 770 between the ears. Forward end 713 of rod 710 seats in space 770. A pivot pin 772 is inserted through the holes in the ears as well as hole 714 in rod 710 to secure the head to the hand and to provide a pivot point. In use, Bias spring 715 urges collar 717 toward head 704. Pins 719 are urged into holes 761 to lock head 704 in position relative to the handle. Collar 717 can be drawn back against spring 715 withdrawing the pins out of the holes allowing head 704 to pivot about pivot pin 772 until a desired angular relationship is reach. The use can release collar 717 and spring 715 will urge the pins 719 into holes 761, locking the drive head in the desired angular position. The holes 761 are positioned so that head 704 can be rotated approximately 180° relative to the handle. Collar 717 can be locked in a withdrawn position by pulling it back until detent 729 engages slot 711.

It is just as likely that the neck 750 may be integrally formed with the collar 717, and the rod 710 have a pin such as 719 formed thereon, with the rod 710 being spring biased within the collar, and the pin 719 normally locked into position to fix the drive head 704 in place. A pull back of the rod, against the spring, releases the head for resetting.

It will be appreciated by those skilled in the art that the various elements described and illustrated herein can be machined from appropriate material such as steel or stainless steel. It also will be appreciated that the various dimensions of the various elements can be varied depending upon the application of the tool. For example the drives can be constructed in conventional sizes such as ¼, 7/16, ½ or ¾ inch. Furthermore, the drive seats can be dimensioned to accommodate any number of drives. Therefore, the foregoing description and accompanying drawings are intended to be illustrative and should not be viewed in a limiting sense.

I claim:

1. A multi-functional adjustable hand tool comprising:

a drive handle;

a drive head pivotally attached to said drive handle;

a locking means for locking said drive head in a desired position relative to said drive handle, said locking means comprising a locking pin operatively associated with said drive handle, and said drive head having a plurality of holes provided thereon to lock said drive head at a desired angular position relative to said drive handle;

a plurality of adapters, each said adapter having a socket at one end, and a multi-tiered drive at its opposite end;

a plurality of extensions, each extension having a drive on one end and a bore and counterbored drive seat formed in an opposite end, and capable of mounting onto one of the plurality of adapters connecting to the drive head;

said pivotally attached drive head is pivotal 180° relative to said handle;

one of said plurality of adapters further comprises a sleeve, said sleeve having a bore formed therethrough, a slidable insert within said sleeve, said insert having a first drive formed on a first end and a second drive formed on a second end, said insert being movable from a first position in which said first drive is exposed, to a second position in which said second drive is exposed, said bore in said sleeve also functioning as a seat for a drive at an end opposite the exposed insert drive.

2. The hand tool of claim 1 wherein said sleeve of said adapter has a cylindrical body with said bore formed there through.

3. The hand tool of claim 1 wherein said sleeve has a generally cylindrical body with a conical portion formed on one end, said bore extending through said cylindrical body and said conical portion.

4. The hand tool of claim 1 wherein said insert has a slot formed therein.

* * * * *